United States Patent [19]

Nestor

[11] 4,429,945

[45] Feb. 7, 1984

[54] TERMINAL FOR BASELESS CARTRIDGE LAMP SOCKETS

[75] Inventor: Charles R. Nestor, Niles, Ohio

[73] Assignee: General Motors Corporation, Detroit, Mich.

[21] Appl. No.: 341,117

[22] Filed: Jan. 20, 1982

[51] Int. Cl.[3] ..... H01R 33/08; H01R 33/12; H01R 11/22

[52] U.S. Cl. ..... 339/252 R; 339/50 R; 339/52 R; 339/56

[58] Field of Search ..... 339/252 R, 57, 56, 52 R, 339/52 S, 50 R

[56] References Cited

U.S. PATENT DOCUMENTS

| | | | |
|---|---|---|---|
| 2,483,165 | 9/1949 | Young | 339/56 |
| 3,156,841 | 11/1964 | Ayres | 339/258 F |
| 3,328,574 | 6/1967 | Linse et al. | 339/56 |
| 3,633,149 | 1/1972 | Maltais | 339/52 R |
| 4,061,940 | 12/1977 | Fitzgerald et al. | 339/56 |

*Primary Examiner*—John McQuade
*Assistant Examiner*—Paula Austin
*Attorney, Agent, or Firm*—F. J. Fodale

[57] ABSTRACT

A socket assembly for a baseless cartridge lamp of the dual filament type has identical terminals for engaging the loop and hook terminals at the opposite ends of the lamp. The terminals have a spring tongue which engages the lamp terminals and a spring support which increases the spring forces acting on the lamp terminals. The terminal has a side wall with a flange for limiting torque deflection in one direction and a second flange which cooperates with the spring support. The spring support has an inturned foot which engages the spring tongue to limit deflection in the opposite direction. The side wall also has an extension for attaching the terminal to a conductor.

3 Claims, 7 Drawing Figures

TERMINAL FOR BASELESS CARTRIDGE LAMP SOCKETS

This invention relates generally to electric terminals and, more particularly, to electric terminals for use in sockets for baseless cartridge lamps or the like having wire terminals at opposite ends.

Terminals and sockets for baseless cartridge lamps are shown in U.S. Pat. No. 3,633,149 granted to Frederick Jean Maltais on Jan. 4, 1972 and in U.S. Pat. No. 4,061,940 granted to James J. Fitzgerald et al on Dec. 6, 1977.

Baseless cartridge lamps may be of the monofilament or dual filament type. The monofilament type commonly have a wire loop terminal at each end as shown in the Maltais patent. On the other hand, the dual filament type commonly have a wire loop terminal at one end and a pair of wire hook terminals at the opposite end as shown in the Fitzgerald et al patent.

Both of these patents show sockets or bases for baseless cartridge lamps which have a plurality of terminals which engage the wire terminals of the baseless cartridge lamp to support the baseless cartridge lamp as well as establish the electrical connections thereto. The terminals shown in the patents comprise a base and a wide upright spring tab at one end of the base for engaging and supporting the lamp terminal.

In each instance, the free end of the spring tab is specifically shaped to engage and support either a wire loop terminal or a wire hook terminal of the baseless cartridge lamp and, consequently, a variety of terminals must be used particularly for dual filament lamps. Moreover, the terminals shown in these patents do not have any means for limiting the deflection of the spring tabs and/or preventing permanent deformation when the baseless cartridge lamps are mounted in the sockets.

The object of this invention is to provide an improved terminal for use in a socket for a baseless cartridge lamp or the like having wire terminals at opposite ends.

A feature of the invention is that the terminal has a spring tongue which is shaped at its free end for engaging and supporting either a wire loop terminal or a wire hook terminal so that identical terminals can be used with monofilament and dual filament lamps.

Another feature of the invention is that the spring tongue is long and narrow so that the free end of the spring tongue which engages and supports the lamp terminal has a high degree of travel to facilitate mounting the lamp in the socket.

Another feature of the invention is that the spring tongue has an integral spring support which provides additional spring forces for enhancing the electrical connection and mechanical support of the spring tongue.

Another feature of the invention is that the spring support has an inturned foot which bottoms out on the spring tongue to limit deflection in one direction and prevent permanent deformation.

Another feature of the invention is that the terminal has a side wall with a flange for limiting deflection of the spring tongue in the other direction and a second flange for cooperating with the spring support.

Another feature of the invention is that the terminal has a conductor attachment which extends from the side wall above the terminal base so that the length of the spring tongue is maximized while the width of the terminal is minimized.

Other objects and features of the invention will become apparent to those skilled in the art as the disclosure is made in the following detailed description of a preferred embodiment of the invention as illustrated in the accompanying sheet of drawing in which.

Figure 1:
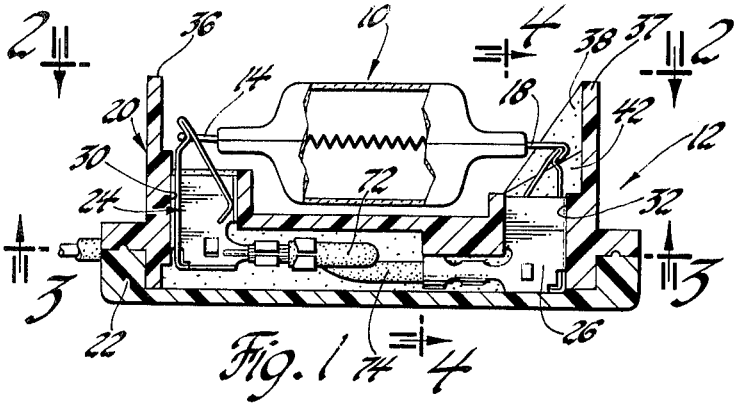
FIG. 1 is a partially sectioned side view of a baseless cartridge lamp mounted in a socket assembly having terminals in accordance with this invention.

Referring now to the drawing, FIG. 1 shows a baseless cartridge lamp 10 mounted in a socket assembly 12. Baseless cartridge lamps are well known and need not be described in detail. The lamp 10 is a dual filament type and, in accordance with standard practice, it has a square loop terminal 14 of round wire at one end and two hook terminals 16 and 18 formed by narrow loops of round wire at the opposite end. The square loop terminals 14 and hook terminals 16,18 serve as the supports and electrical contacts for the baseless cartridge lamp 10. The sizes and shapes of the loop terminal 14 and hook terminals 16,18 are standardized.

The socket assembly 12 comprises a plastic socket 20, a plastic cover 22 for the bottom of the socket 20 and three terminals 24,26,28 which are mounted in cavities 30,32,34 extending through the socket 20. The top of the socket 20 has upstanding shields 36 and 37 at the respective ends to protect the baseless cartridge lamp 10 particularly, the wire terminal portions. The shield 37 is designed for the end of the lamp 10 which has the hook terminals 16,18 and it includes two triangularly shaped side walls 38 and 40 which are located at the outside edges of the two side-by-side cavities 32 and 34.

The side walls 38 and 40 are spaced apart so as to guide the hook terminals 16 and 18 into engagement with the terminals 26 and 28 when the lamp 10 is mounted in the socket 10. The shield 37 also includes a triangular shaped divider wall 42 of lesser height between the side walls 32 and 34. The divider wall 42 prevents contact between the protruding portions of the terminals 26 and 28.

Figure 5:
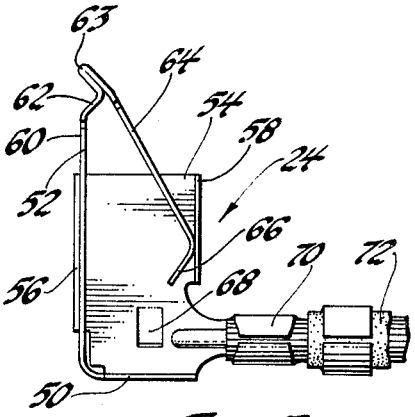
FIG. 5 is an enlarged side view of one of the terminals shown in FIG. 1.
Figure 6:
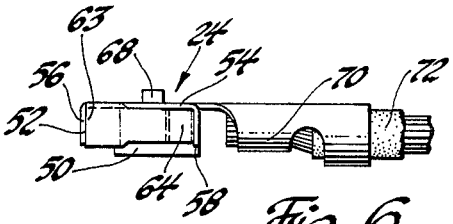
FIG. 6 is a top view of the terminal shown in FIG. 5.
Figure 7:
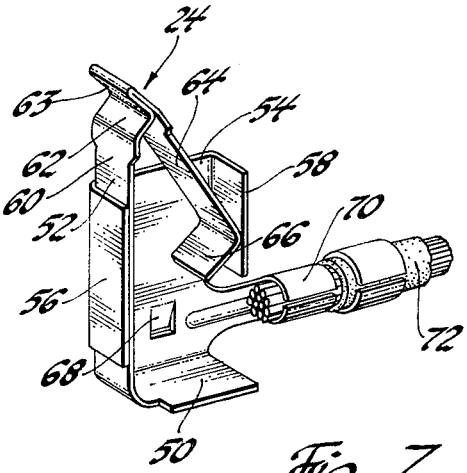
FIG. 7 is a perspective view of the terminal shown in FIG. 5.

The terminals 24, 26 and 28 are identical. The details of the terminal 24 (which is typical) are best shown in FIGS. 5, 6 and 7 which are enlarged views.

Terminal 24 comprises a base 50 which has an upright spring tongue 52 integrally attached to a front edge of the base by a 90 degree radius bend and a side wall 54 integrally attached to a side edge of the base by a 90 degree radius bend. The end portions of the side wall 54 are turned in over the base 50 to provide forward and rearward flanges 56 and 58.

The forward flange 56 lies against the front surface of the spring tongue 52 to provide a forward stop which prevents any substantial deflection of the spring tongue 52 in the forward direction. The rearward flange 58 is spaced rearwardly of the spring tongue 52 and forms a rearward stop as explained later.

Figure 2:
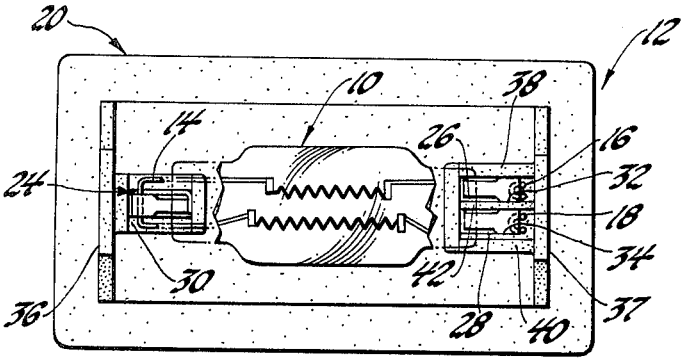
FIG. 2 is a top view of the socket assembly shown in FIG. 1.

The spring tongue 52 projects above the side wall 54 and flanges 56 and 58 so that the free end 60 of the spring tongue 54 engages either the loop terminal 14 or hook terminals 16,18 of the lamp 10 without any interference by the side wall and flanges. The free end 60 of the spring tongue 52 is bent in the lateral direction of the spring tongue 52 to form a V-shaped hook 62 which opens in the forward direction as shown in FIGS. 5 and 7. The V-shaped hook 62 is narrow enough to fit through the square loop terminal 14 as shown in FIG. 2 so that the cross leg of the square loop terminal 14 can nest in the crotch of the V-shaped hook for vertical location as shown in the left-hand portion of FIG. 1. The V-shaped hook 62 is a little wider than the hook terminal 16 or 18 but still narrow enough so that terminals 26 and 28 can be placed side-by-side as shown in FIG. 2. The upper leg 63 of the V-shaped hook also substantially matches the inturned end of the hook terminal 16 or 18 so that the end of the hook terminal 16 or 18 hooks over the V-shaped hook 62 for vertical location as shown in the right-hand portion of FIG. 1. The terminal 24 is thus engageable with either a square loop terminal or a hook terminal.

The terminal 24 also has a spring support 64 which is integrally attached to the end of the spring tongue 52 by a reverse fold which overlies the upper leg 63 of the V-shaped hook. The spring support 64 extends back toward the base 50 and slideably engages the forward surface of the rearward flange 58 so that the spring support 64 increases the spring forces when the spring tongue 52 is deflected rearwardly.

The lower end of the spring support 64 has an inturned foot 66 which engages the lower end of the spring tongue 52 to limit the rearward deflection of the spring tongue 52 and prevent permanent deformation as shown in phantom lines in FIG. 5.

The side wall 54 has a lanced lock tab 68 for retaining the terminal 24 in the cavity 30 and a rearward extension 70 which is formed into a conventional crimp barrel for attaching the terminal 24 to an insulated conductor 72.

Figure 3:
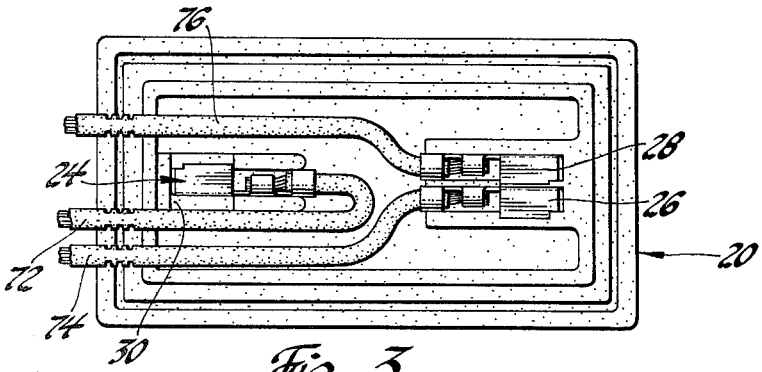
FIG. 3 is a section taken substantially along the line 3—3 of FIG. 1 looking in the direction of the arrows.
Figure 4:
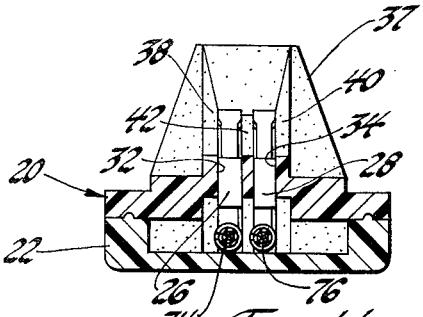
FIG. 4 is a section taken substantially along the line 4—4 of FIG. 1 looking in the direction of the arrows.

The terminals 24, 26 and 28 are attached to the insulated conductors 72, 74 and 76 in a conventional manner and then inserted into the cavities 30, 32 and 34 from the bottom end of the socket 20. The bottom end of the socket 20 is hollow to provide space for the conductors 72, 74 and 76 as shown in FIGS. 1, 3 and 4.

After the terminals are mounted in the socket 20, a cover 22 is placed on the bottom of the socket 20 and secured thereto by ultrasonic welding.

The baseless cartridge lamp 10 is mounted in the socket assembly 12 by hooking the hook terminals 16,18 over the ends of the terminals 26 and 28; the hook terminals 16,18 being guided into engagement with the terminals 26 and 28 by the side walls 38 and 40. The baseless cartridge lamp 10 is then pulled to the left as viewed in FIG. 1 and the loop terminal 14 is positioned on the terminal 24.

I wish it to be understood that I do not desire to be limited to the exact details of construction shown and described, for obvious modifications will occur to a person skilled in the art.

The embodiments of the invention in which an exclusive property or privilege is claimed are defined as follows:

1. A terminal for engaging and supporting a wire loop terminal or a wire hook terminal of a baseless cartridge lamp or the like, comprising;

a base having a spring tongue integrally attached to a forward edge of the base, a side wall integrally attached to a side edge of the base, said side wall having a flange juxtaposed the spring tongue for limiting deflection of the spring tongue in one direction and a second flange spaced from the spring tongue in the opposite direction, said spring tongue having a free end which extends beyond the side wall and flanges and which is bent to provide a hook for engaging and supporting either a wire loop terminal or a wire hook terminal, a spring support which extends from the free end of the spring tongue and slideably engages the second flange to increase the spring forces when the spring tongue is deflected in the opposite direction, and and inturned foot at the end of the spring support which engages the spring tongue to limit the deflection of the spring tongue in said opposite direction.

2. A terminal for engaging and supporting a wire loop terminal or a wire hook terminal of a baseless cartridge lamp or the like, comprising;

a base having an upright spring tongue integrally attached to a forward edge of the base, a side wall integrally attached to a side edge of the base, said side wall having a forward flange ahead of the spring tongue for limiting forward deflection of the spring tongue and a rearward flange spaced rearwardly of the spring tongue, said spring tongue having a free end which is above the side wall and flanges and which is bent in the lateral direction of the spring tongue to provide a hook for engaging and supporting either a wire loop terminal or a wire hook terminal, a spring support which extends from the free end of the spring tongue back toward the base and slideably engages the rearward flange to increase the spring forces when the spring tongue is deflected rearwardly, and an inturned foot at the lower end of the spring support which engages a lower portion of the spring tongue to limit the rearward deflection of the spring tongue.

3. A terminal for engaging and supporting a wire loop terminal or a wire hook terminal of a baseless cartridge lamp or the like, comprising;

a base having an upright spring tongue integrally attached to a forward edge of the base, a side wall integrally attached to a side edge of the base, said side wall having a forward flange ahead of the spring tongue for limiting forward deflection of the spring tongue and a rearward flange spaced rearwardly of the spring tongue, said spring tongue having a free end which is above the side wall and flanges and which is bent in the lateral direction of the spring tongue to provide a V-shaped hook which opens in the forward direction for engaging and supporting either a wire loop terminal or a wire hook terminal, a spring support which extends from the free end of the spring tongue back toward the base and slideably engages the rearward flange to increase the spring forces when the spring tongue is deflected rearwardly, an inturned foot at the lower end of the spring support which engages a lower portion of the spring tongue to limit the rearward deflection of the spring tongue, and a rearward extension on the side wall above the base for attaching the terminal to a conductor.

* * * * *